US010238192B2

(12) United States Patent
Khan

(10) Patent No.: US 10,238,192 B2
(45) Date of Patent: Mar. 26, 2019

(54) UMBRELLA WITH DEPLOYABLE CURTAIN

(71) Applicant: Mudassar Khan, Lewisville, TX (US)

(72) Inventor: Mudassar Khan, Lewisville, TX (US)

( * ) Notice: Subject to any disclaimer, the term of this patent is extended or adjusted under 35 U.S.C. 154(b) by 0 days.

(21) Appl. No.: 15/795,995

(22) Filed: Oct. 27, 2017

(65) Prior Publication Data

US 2018/0153270 A1 Jun. 7, 2018

Related U.S. Application Data

(60) Provisional application No. 62/413,526, filed on Oct. 27, 2016.

(51) Int. Cl.
*A45B 25/18* (2006.01)

(52) U.S. Cl.
CPC ..... *A45B 25/18* (2013.01)

(58) Field of Classification Search
CPC . A45B 25/18; A45B 23/00; A45B 2023/0093; E04H 15/28; F16G 11/105; F16G 11/106; F16G 11/108
See application file for complete search history.

(56) References Cited

U.S. PATENT DOCUMENTS 1,774,909 A * 9/1930 Wells ..... A45B 23/00 135/15.1
2,502,984 A * 4/1950 Parmenter ..... A45B 25/18 135/16
2,546,228 A * 3/1951 Ferruccio ..... A45B 25/00 135/16
2,867,875 A * 1/1959 Davison ..... F16G 11/106 24/133
4,022,233 A * 5/1977 Grundman ..... A45B 15/00 135/20.1
4,766,920 A * 8/1988 Grady, II ..... A45B 25/165 135/20.2
5,449,012 A * 9/1995 Friedman ..... A45B 3/00 135/16
5,740,822 A * 4/1998 Einck ..... A45B 23/00 135/16
5,806,547 A * 9/1998 Derlinga ..... A45B 23/00 135/117
7,261,138 B2 * 8/2007 Judkins ..... E06B 9/324 160/178.2

(Continued)

FOREIGN PATENT DOCUMENTS

GB 190318749 A * 11/1903

*Primary Examiner* — Noah Chandler Hawk
(74) *Attorney, Agent, or Firm* — Global Intellectual Property Agency, LLC; Daniel Boudwin

(57) ABSTRACT

A device for extending the zone of protection of an umbrella. The device includes a curtain that can extend from a peripheral edge of an umbrella canopy. The curtain extends away from the canopy to envelope a user of the umbrella when the umbrella is in a deployed position. The curtain is selectively movable between a deployed position and a retracted position by a plurality of cords affixed to the curtain. In the retracted position, the curtain is compressed against the peripheral edge of the canopy. The plurality of cords passes through a cord lock, wherein the cord lock can prevent further movement of the curtain. The cord lock is operably connected to a switch disposed on a handle of the umbrella.

12 Claims, 5 Drawing Sheets

(56) References Cited

U.S. PATENT DOCUMENTS

| | | | | |
|---|---|---|---|---|
| 7,434,591 | B2 * | 10/2008 | Church | A45B 23/00 135/16 |
| 7,503,336 | B2 | 3/2009 | Labarbera | |
| 8,042,561 | B2 | 10/2011 | Varga et al. | |
| 8,079,378 | B1 * | 12/2011 | Derlinga | A45B 23/00 135/16 |
| 2002/0046761 | A1 * | 4/2002 | Liang | A45B 25/14 135/16 |
| 2004/0020522 | A1 | 2/2004 | James | |
| 2005/0028851 | A1 * | 2/2005 | Knoepp | A45B 25/20 135/15.1 |
| 2007/0006908 | A1 | 1/2007 | Adis | |
| 2012/0273016 | A1 | 11/2012 | Pandak | |
| 2014/0360542 | A1 * | 12/2014 | Beyer | A45B 25/06 135/28 |

* cited by examiner

UMBRELLA WITH DEPLOYABLE CURTAIN

CROSS REFERENCE TO RELATED APPLICATIONS

This application claims the benefit of U.S. Provisional Application No. 62/413,526 filed on Oct. 27, 2016. The above identified patent application is herein incorporated by reference in its entirety to provide continuity of disclosure.

BACKGROUND OF THE INVENTION

The present invention relates to umbrellas. Specifically, the present invention provides an umbrella having a deployable curtain that is configured to extend away from the peripheral edge of a canopy.

Although conventional umbrellas protect a user from rain, generally, the protection is limited to rain falling substantially perpendicular to the ground. Often when rain falls, wind accompanies the rain. This wind blows the rain sideways, making a standard umbrella useless. Moreover, the standard breadth of protection offered by a conventional umbrella fails to protect the user from exposure to winds, especially in the winter months, and radiation emanating from the sun.

Several devices have been proposed to expand the zone of protection offered by an umbrella. One such device provides a vertically deployable sun shade that needs to be manually pulled down from the canopy of the umbrella. Another similar device provides a drape that clips on to the canopy of an umbrella. Therefore, a need exists for an umbrella having a vertically deployable curtain that can be operated with minimal energy expenditure, such as one having a curtain operated easily by a switch disposed on a handle of the umbrella.

SUMMARY OF THE INVENTION

In view of the foregoing disadvantages inherent in the known types of umbrellas with deployable drapes or curtains now present in the prior art, the present invention provides an umbrella with a deployable curtain wherein the same can be utilized for providing convenience for the user when deploying the curtain with minimal effort through a switch activated deployment mechanism. The present umbrella comprises a plurality of ribs radially affixed to a top end of a shaft. A canopy is secured to and supported by the ribs. A curtain is affixed to the peripheral edge of the canopy, allowing the curtain to be vertically deployed therefrom to include the body of the user within the umbra of the umbrella. A plurality of cords is operably connected to the curtain. The plurality of cords feed through a cord lock disposed on the shaft, wherein the cord lock is biased into a closed position thereby keeping the plurality of cords from passing through the cord lock. The cord lock is operably connected to a switch, wherein the switch is configured to release the cord lock from the closed position when actuated.

One object of the present invention is to provide an umbrella having a vertically deployable curtain affixed to the peripheral edge of a canopy of the umbrella, wherein the curtain can be deployed by actuation of a switch.

Another object of the present invention is to provide an umbrella having a canopy that can be raised and lowered, similar to a conventional umbrella, without having to detach the deployable curtain.

A further object of the present invention is to provide an umbrella having a curtain deployable and retractable by motorized means.

Yet another object of the present invention is to provide a cord lock comprising a pair of opposing cylinders and adjustably secured to a plurality of cords, wherein the cords are operably connected to a deployable curtain, such that the opposing cylinders are biased to retain the cords in an immobile position and unbiased by actuation of a switch.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
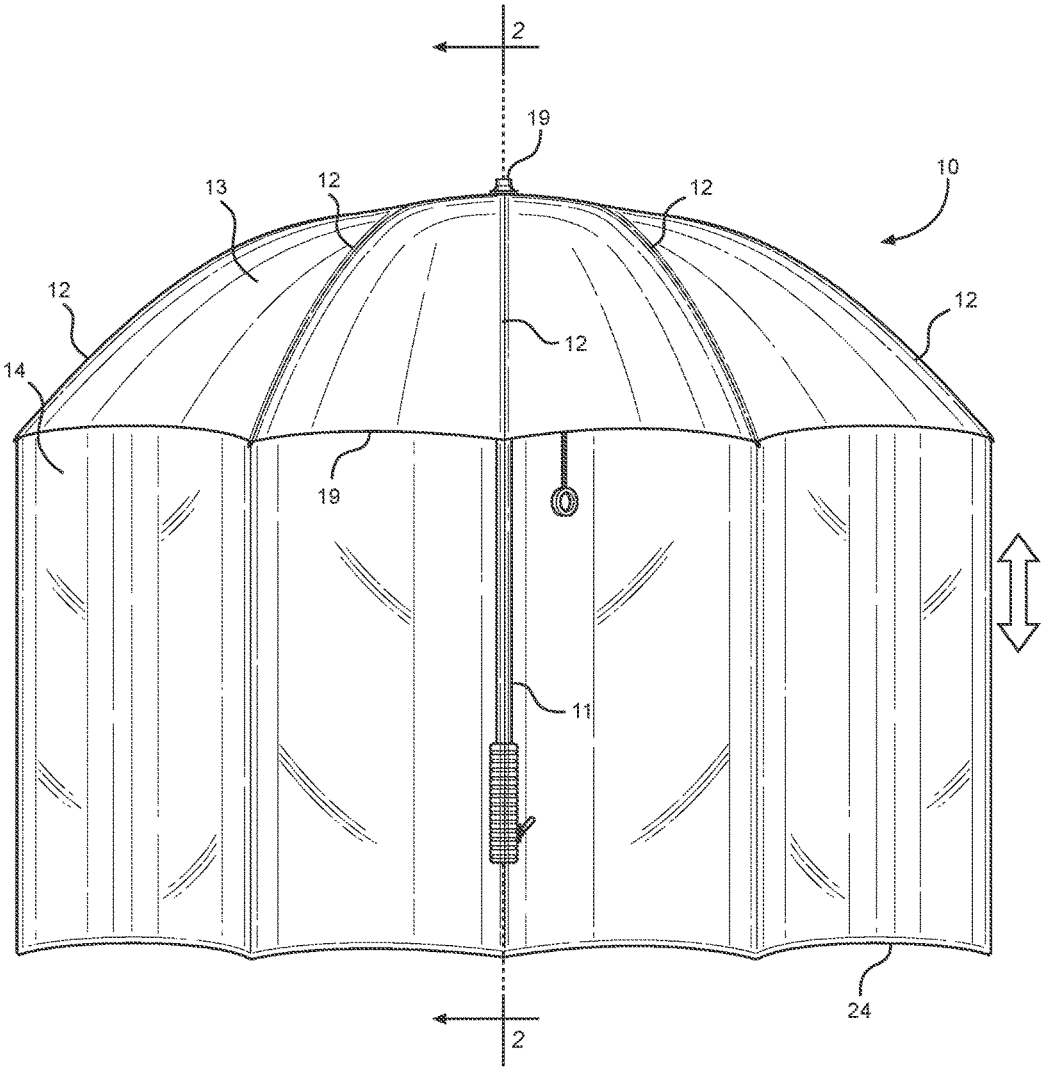
FIG. 1A shows a front side elevation view of an embodiment of the umbrella with deployable curtain.

Reference is made herein to the attached drawings. Like reference numerals are used throughout the drawings to depict like or similar elements of the umbrella with deployable curtain. The figures are intended for representative purposes only and should not be considered to be limiting in any respect. Unless specifically limited to a single unit, "a" is intended to be equivalent to "one or more" throughout the present disclosure.

Figure 1B:
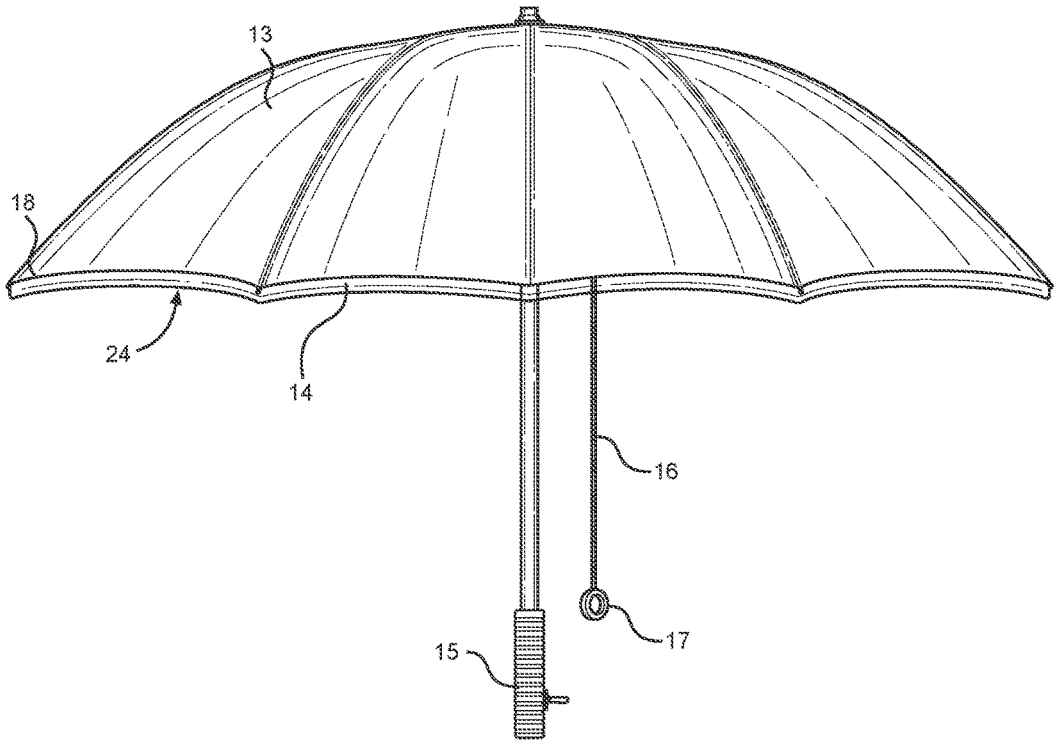
FIG. 1B shows a front side elevation view of an alternative position of an embodiment of the umbrella with deployable curtain.

Referring now to FIGS. 1A and 1B, there is shown a front side elevation view of an embodiment of the umbrella with deployable curtain in a deployed position and a front side elevation view of an embodiment of the umbrella with deployable curtain in a retracted position. The umbrella with deployable curtain 10 comprises a shaft 11 having a top end 19 and a bottom end 15. In the shown embodiment, the bottom end 15 is a handle. A plurality of ribs 12 is affixed radially to the top end 19 of the shaft. The ribs 12 extend outward from the shaft 11 and, in the present embodiment, are spaced equidistance from each other. A canopy 13 is fastened to the ribs 12, wherein the ribs 12 vertically support the canopy. The ribs 12 arc downward so that a peripheral edge 18 of the canopy 13 is below the top end 19 of the shaft 11. The canopy 13 is water impermeable.

A curtain 14 having a proximal end 19 opposed to a distal end 24 is affixed to the canopy 13. In the embodiment shown, the proximal end 19 of the curtain 14 is affixed to the canopy 13 along the peripheral edge 18 of the canopy. The curtain 14 is monolithic with the peripheral edge 18 of the canopy. The curtain 14 can be sewn, glued, pinned or fastened to the canopy by any proper means. The curtain 14 can be selectively deployed by a user into a deployed position, as shown in FIG. 1A, from a retracted position, as shown in FIG. 1B, and selectively retracted by a user into the retracted position from the deployed position. In the retracted position, the curtain 14 is compressed against the canopy 13. More specifically, in the retracted position, the distal end 24 of the curtain is compressed against the peripheral edge 18 of the canopy 13. The horizontal cross section of the curtain 14 comprises the same shape as the peripheral edge of the canopy 13. In one embodiment, the curtain 14 is composed of clear or tinted plastic, such as polyurethane. In some of these embodiments, the curtain 14 is broken into tinted segments and clear segments, giving the curtain an aesthetic alternating color pattern. In another embodiment, the curtain 14 is composed of a water proof fabric and has a viewing window disposed therein.

Figure 2:
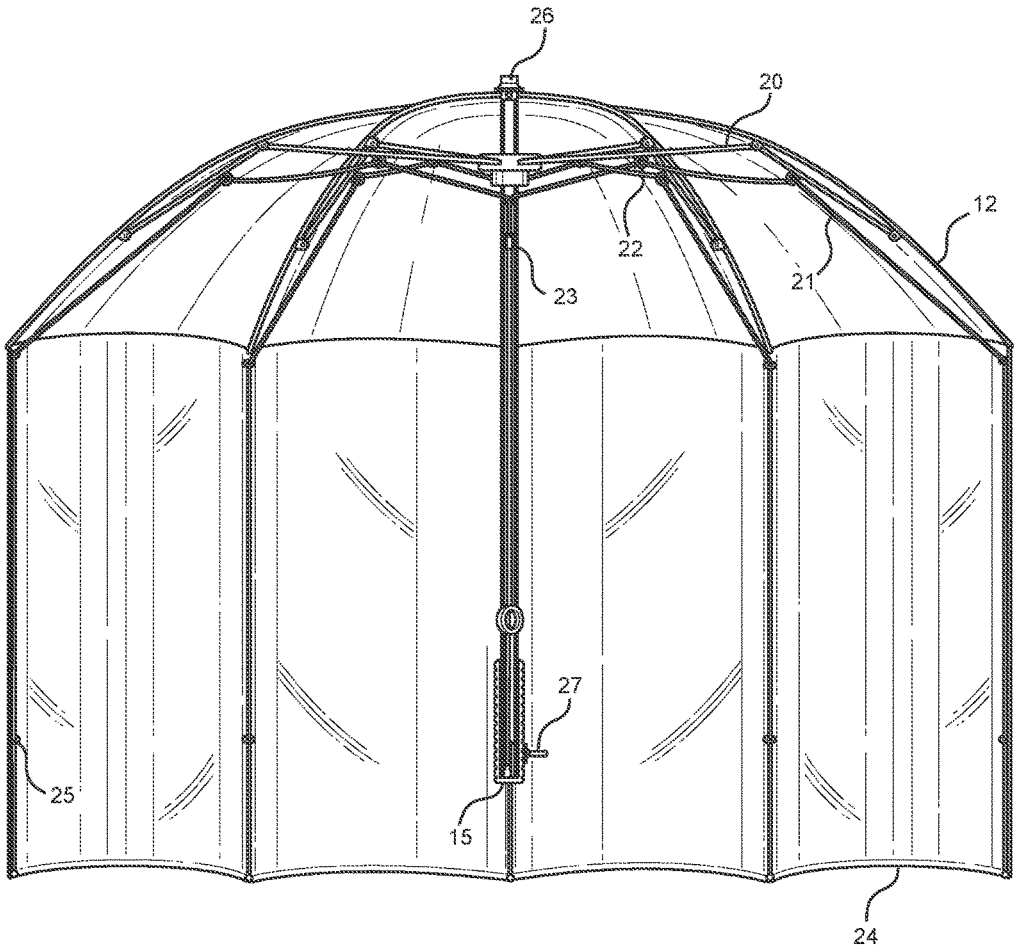
FIG. 2 shows a cross sectional view taken along line 2-2 of an embodiment of the umbrella with deployable curtain.

Referring now to FIG. 2, there is shown a cross-sectional view of the umbrella with deployable curtain. A plurality of crossbars 20 is disposed between the shaft 11 and the plurality of ribs 12. The crossbars 20 aid in supporting the canopy 13. Each crossbar 20 is disposed diagonally between the shaft 11 on one end of the crossbar and a rib 12 on the opposing end of the crossbar 20. In the shown embodiment, the crossbars 20 are secured to the shaft 11 by a bracket. In some embodiments, the bracket can slide along the shaft 11 and lock into place by a locking pin. In some embodiments, the locking pin is biased by a spring that protrudes outward from the shaft 11 and is received by a locking pin aperture in the bracket to secure the bracket in a predetermined position on the shaft 11.

In embodiments where the bracket securing the crossbars 20 to the shaft 11 can slide along the shaft 11, the crossbars 20 are pivotally connected to the ribs 12 and the shaft 11. In this embodiment the ribs 12 are also pivotally connected to the shaft 11. An example of a pivotal connection that could be utilized in this embodiment is a t-hinge. In this way, a user can open and close the canopy 13 by sliding the bracket up and down the shaft 11.

The umbrella with deployable curtain device further includes a plurality of cords 21 that enable the curtain to deploy and retract. In the illustrated embodiment, the plurality of cords each suspend from a crossbar 20. In the illustrated embodiment, each cord 21 is threaded through a support ring 22 affixed to a crossbar 20, wherein the support ring 22 is positioned below the crossbar. In the illustrated embodiment, there is one support ring per crossbar 20. However, in other embodiments, the support rings 22 are affixed to the crossbars 20 and the ribs 12.

The cords 21 are operably connected to the curtain 14, wherein the cords 21 are configured to selectively raise the curtain 14 into the retracted position from the deployed position and hold the curtain 14 in the retracted position. In the illustrated embodiment, the cords 21 are fastened to the distal end 24 of the curtain 14. From the distal end 24 of the curtain 14, the cords 21 pass through apertures 25 in the curtain. The apertures 25 are longitudinally aligned between a rib 12 and the distal end 24 of the curtain 14. Each cord 21 further passes through a support ring 22 disposed on a crossbar 20. All of the cords pass through a cord lock 23 disposed on the shaft 11. In certain embodiments, the cord lock 23 is disposed in or on the bracket to which the crossbars 20 are secured. In other embodiments, the shaft 11 is hollow and the cord lock 23 is disposed within the shaft 11.

Referring back to FIGS. 1B and 1A, the cords 21 terminate at a tail end 17, see FIG. 1B. In the illustrated embodiment, the cords merge, i.e. become inseparable, into a pull string 16 below the cord lock 23 before terminating at the tail end 17. In the shown embodiment, the tail end 17 is shown as comprising a grip, such as a finger ring, to assist the user in pulling the pull string 17. In some embodiments, the pull string 16 is formed by a braid of the cords 21. In other embodiments, the pull string is a single cord strand to which the other cords 21 are knotted. In operation, a user can pull the pull string 16 to bring the curtain 14 into the retracted position from the deployed position.

Figure 3:
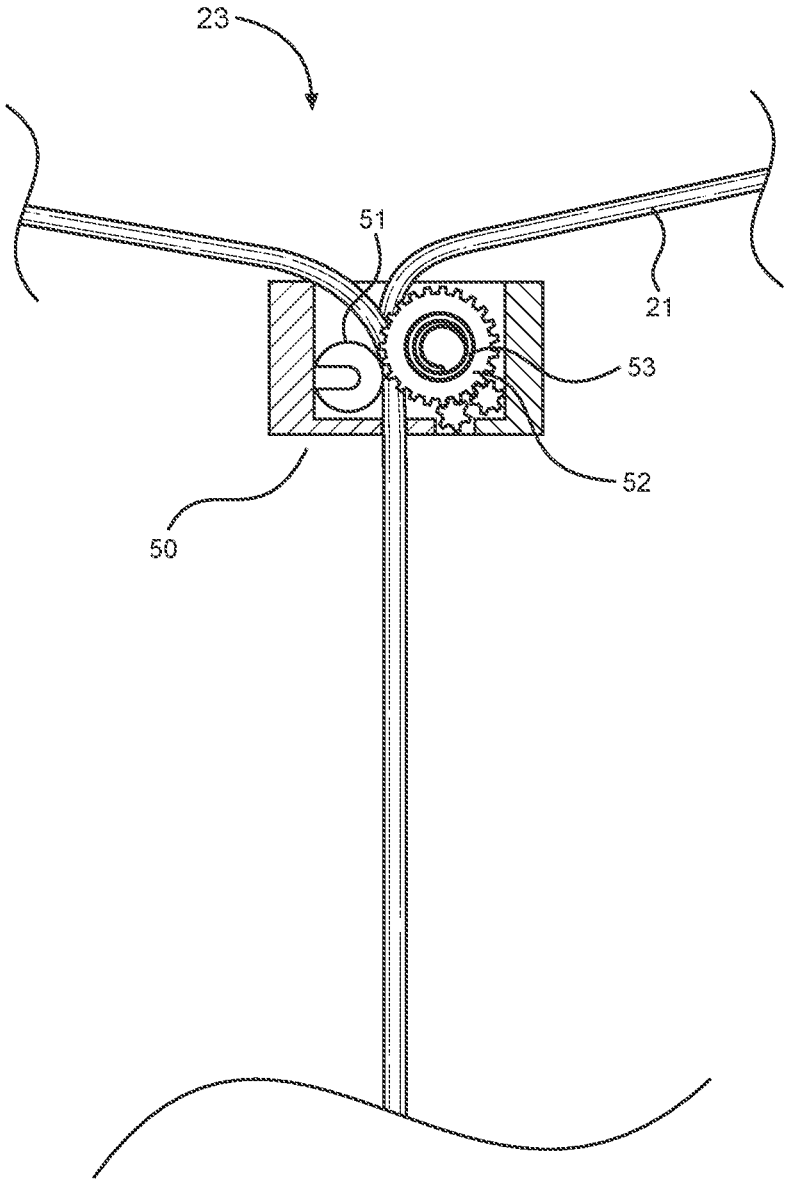
FIG. 3 shows a close-up side elevation view of a lock mechanism of an embodiment of the umbrella with deployable curtain.

The curtain 14 is held in a selected position by the cord lock 23. The cord lock 23 is biased into a closed position, as shown in FIG. 3, wherein the cords 21 are prevented from passing through the cord lock 23, thereby allowing the curtain 14 to be retained in a selected position. The cord lock 23 is operably connected to a switch 27 disposed on the bottom end 15 of the shaft 11. The switch 27 is configured to unbias the cord lock 23 from the closed position when actuated. Thus, when the switch 27 is actuated, unbiasing the cord lock 23 from the closed position, the cords 21 are permitted to pass through the cord lock 23 allowing gravitational forces to freely deploy the curtain 14 into the deployed position from the retracted position.

In the embodiment shown in FIG. 3, there is shown an embodiment of the cord lock. The cord lock 23 comprises a static cylinder 51 opposed to a floating cylinder 52, wherein the center longitudinal axis of the static cylinder 51 and the floating cylinder 52 are parallel. A cord lock spring 53 is fastened to the floating cylinder 52, wherein the cord lock spring 53 is configured to bias the floating cylinder 52 to press against the static cylinder 51, i.e. bias the floating cylinder 52 in the closed position. The cords 21 extend between the static cylinder 51 and the floating cylinder 52. The static cylinder 51, the floating cylinder 52 and the cord lock spring 53 are contained within a cord lock housing 50. In the shown embodiment the cord lock housing 50 has an open top end and an opening in a bottom side, wherein the open top end and the opening in the bottom side are opposed. The cords 21 pass into the cord lock housing 50 through the open top end and pass out of the cord lock housing 50 through the opening in the bottom side.

In the present embodiment, the floating cylinder 52 can selectively move out of the closed position when force is applied to the floating cylinder 52 in a horizontal vector away from the static cylinder 51. This force can be applied by a lever, wherein the lever is actuated by the switch 27, that pulls the cord lock spring 53 away from the static cylinder 51. Alternatively, this force can be applied by a user pulling on the tail end 17 of the cords in a direction toward the floating cylinder 52, thereby moving the floating cylinder 52 away from the static cylinder 51.

Figure 4:
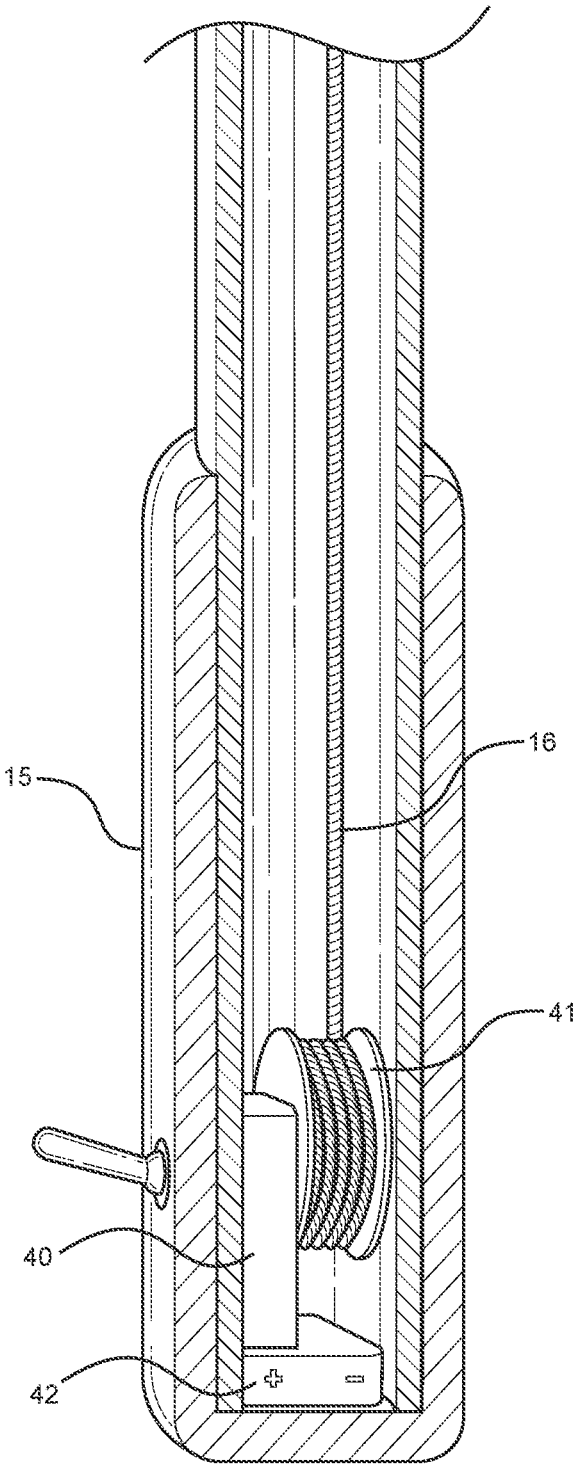
FIG. 4 shows a cross sectional view taken along line 2-2 of a bottom end of an alternate embodiment of the umbrella with deployable curtain.

FIG. 4 depicts an alternate embodiment of the umbrella with deployable curtain 10 having a motorized mechanism for selectively moving the curtain 14 between the deployed and retracted positions. In the shown embodiment, the motorized mechanism comprises a spool 41 operably connected to a motor 40. The motor is electrically connected to a power source 42 and operably connected to the switch 27. In the illustrated embodiment, the pull string 16 formed by the cords 21 is affixed to the spool 41, wherein the pull string 16 is configured to wind and unwind around the spool 41. In certain other embodiments, the cords 21 do not form a pull string 16 and each cord 21 is fastened to the spool 41. The motor 40 is configured to bidirectionally rotate the spool 41, thereby winding and unwinding the pull string 16 or cords 21 affixed to the spool 41. The switch 27 is configured to selectively raise, lower or hold the position of the curtain 14 when actuated by a user.

Further, in the motorized embodiments, the function of the cord lock 23 is replaced by the motorized spool 41. Since the rotation of the spool 41 is controlled by the switch 27, via the motor 40, the spool 41 can selectively retain the position of the curtain 14. In these embodiments, the cord lock 23 is not biased into a closed position and becomes merely a guide for the cords 21, wherein the cords 21 converge through the cord lock 23 but are not prevented from passing through the cord lock 23.

In the illustrated embodiment, the motor 40, spool 41, power source 42 and pull string 16, or alternatively the cords 21, are contained within a hollow shaft 11. In particular, the spool 41, motor 40 and power source 42 are located within the bottom end 15 of the shaft 11.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella, comprising:

a shaft having a top end opposed to a bottom end;

a canopy supported by a plurality of ribs radially affixed to the shaft at the top end of the shaft;

a plurality of crossbars configured to support the plurality of ribs, wherein each crossbar of the plurality of crossbars is affixed on a first end to the shaft and on a second end to a rib of the plurality of ribs;

a curtain having a distal end opposed to a proximal end, wherein the proximal end is fastened to an outermost edge of the canopy;

a plurality of cords operably connected to the curtain, wherein the plurality of cords is configured to selectively raise the curtain into a retracted position, such that the curtain is compressed against the peripheral edge of the canopy, and a deployed position, such that the curtain extends away from the peripheral edge of the canopy;

wherein each cord of the plurality of cords passes through a support ring, wherein the support ring is directly secured to a crossbar of the plurality of crossbars between a pair of opposing ends of the crossbar;

a cord lock disposed on the shaft, wherein the cord lock receives the plurality of cords therethrough and is biased into a closed position, such the plurality of cords is prevented from passing through the cord lock when in the closed position;

the cord lock configured to allow the plurality of cords to pass through when in an open position.

2. The umbrella of claim 1, wherein the plurality of ribs is pivotally affixed to the shaft and the plurality of crossbars is pivotally affixed on the first end to the shaft and pivotally affixed on the second end to the rib of the plurality of ribs.

3. The umbrella of claim 1, wherein the plurality of cords merge into a pull string between the cord lock and the bottom end of the shaft.

4. The umbrella of claim 1, wherein the cord lock comprises a static cylinder opposed to a floating cylinder, wherein the floating cylinder is biased to press against the static cylinder by a spring.

5. The umbrella of claim 1, wherein the bottom end is a handle.

6. The umbrella of claim 1, wherein each cord of the plurality of cords passes through a plurality of apertures disposed in the curtain.

7. The umbrella of claim 1, wherein the distal end of the curtain is configured to extend beyond the bottom end of the shaft when in the deployed position.

8. The umbrella of claim 1, wherein the curtain is tinted.

9. The umbrella of claim 1, wherein the curtain is directly affixed to the canopy at a distal periphery of the canopy.

10. An umbrella, comprising:

a shaft having a top end opposed to a bottom end;

a canopy supported by a plurality of ribs radially affixed to the shaft at the top end of the shaft;

a plurality of crossbars configured to support the plurality of ribs, wherein each crossbar of the plurality of crossbars is affixed on a first end to the shaft and on a second end to a rib of the plurality of ribs;

a curtain having a distal end opposed to a proximal end fastened to a peripheral edge of the canopy;

a plurality of cords operably connected to the curtain, wherein the plurality of cords is configured to selectively raise the curtain into a retracted position, wherein the curtain is compressed against the peripheral edge of the canopy, from a deployed position, wherein the curtain is not compressed against the peripheral edge of the canopy and extends downward therefrom;

wherein each cord of the plurality of cords passes through a support ring, wherein the support ring is directly secured to a crossbar of the plurality of crossbars between a pair of opposing ends of the crossbar;

a spool, wherein the plurality of cords is fastened to the spool;

a motor operably connected to a power source and a switch, whereby the motor is configured to selectively rotate the spool and is controlled by the switch.

11. The umbrella of claim 10, wherein the spool, the motor and the power source are disposed within the bottom end of the shaft.

12. The umbrella of claim 10, wherein the curtain is directly affixed to the canopy at a distal periphery of the canopy.

* * * * *